United States Patent [19]

Moeller

[11] 4,250,396

[45] Feb. 10, 1981

[54] HEATED DRAFTING BOARD

[75] Inventor: Arnold T. Moeller, Chesterton, Ind.

[73] Assignee: Walter Leuca, Merrillville, Ind.

[21] Appl. No.: 72,144

[22] Filed: Sep. 4, 1979

Related U.S. Application Data

[63] Continuation of Ser. No. 911,770, Jun. 2, 1978, abandoned.

[51] Int. Cl.[3] ..... H05B 1/00

[52] U.S. Cl. ..... 219/218; 219/201; 312/231; 312/236

[58] Field of Search ..... 219/200, 201, 218, 213, 219/345, 520-522, 549; 312/231, 236; 248/441 R; 108/50, 23; 33/1 AA, 75, 76

[56] References Cited

U.S. PATENT DOCUMENTS

| | | | |
|---|---|---|---|
| 1,401,458 | 12/1921 | Boon | 248/441 C X |
| 2,024,153 | 12/1935 | Eskin | 219/520 |
| 2,612,585 | 9/1952 | McCann | 219/345 |
| 2,674,062 | 4/1954 | Tull | 312/231 X |
| 2,834,862 | 5/1958 | Meyers | 219/345 |
| 2,939,807 | 6/1960 | Needham | 219/345 X |
| 2,963,565 | 12/1960 | Moore et al. | 219/345 |
| 3,041,441 | 6/1962 | Elbert et al. | 219/345 |
| 3,156,813 | 11/1964 | Trainer | 219/202 X |
| 3,420,981 | 1/1969 | Martinet | 219/218 |
| 4,099,469 | 7/1978 | Sahli | 312/231 X |

FOREIGN PATENT DOCUMENTS

| | | | |
|---|---|---|---|
| 573303 | 3/1924 | France | 219/218 |
| 840028 | 1/1939 | France | 219/218 |
| 1074125 | 3/1954 | France | 312/231 |
| 1512954 | 6/1978 | United Kingdom | 312/231 |

*Primary Examiner*—C. L. Albritton

*Attorney, Agent, or Firm*—Walter Leuca

[57] ABSTRACT

An electrically heated drafting board having a drawing surface temperature ranging between 80° and 90° F. The drafting board having a plurality of interconnected parallel grooves spaced apart the length thereof. The grooves are provided in the underside of the drafting board and serve to receive an electric heating wire. A panel member is connected to the underside of the board overlapping the grooves and wire therein. The electric heating wire forming the heating circuit terminates with a cord exterior of the board having a plug for inserting in an electric receptacle for the power source. A control is provided in the circuit to regulate the voltage. The electric heating circuit provides sufficient heat to the drafting board so that the drawing surface is heated to a temperature ranging between 80° and 90° F.

8 Claims, 4 Drawing Figures

HEATED DRAFTING BOARD

This is a continuation of application Ser. No. 911,770, filed June 2, 1978, now abandoned.

BACKGROUND OF THE INVENTION

1. Field of the Invention

This invention relates generally to drafting boards and more particularly to a heated drafting board.

2. Description of the Prior Art

Tracing paper having plastic coating such as Mylar possesses strength, improved weathering qualities and last longer among other superior qualities. Plastic lead pencils are generally used to draw on paper such as Mylar. The lead of such pencils hold their point better and reflect less than graphite lead making such drawings particularly suitable for microprint reproduction. In addition, plastic lead does not smear as readily as graphite lead. A principal disadvantage of such plastic paper is that the surface characteristics thereof function to increase the drag or resistance to the movement of the plastic lead point of pencils which are suitable for use on plastic paper, thereby increasing the frequency of breakage of the point requiring frequent sharpening. The added drag provided by the paper requires application of more pressure on the pencil point which causes the breakage of the point. The added pressure also increases the lead debris in the wake of a line being drawn increasing the possibility of smudges. The additional pressure on the pencil to overcome the increased drag provided by the Mylar paper to the movement of the plastic lead point increases the fatigue of the draftsman which is a major complaint of drawing on Mylar with plastic lead. Additionally, modern drafting rooms are generally air conditioned to provide comfort to the draftsman. However, lowering of the temperature affects the Mylar drafting paper and the plastic lead of the pencil so that the resistance of the plastic paper to the lead flow is increased.

SUMMARY OF THE INVENTION

I have found that by heating the drafting board only sufficiently to increase the temperature of the plastic drafting paper to approximately a range between 80° to 90° F., the resistance of plastic drafting paper to plastic lead is greatly reduced requiring less pressure on the pencil resulting in less breakage of the lead point, less debris left in the wake of a line being drawn thereby reducing the chances of producing smudges and smears and most importantly, reducing the effort applied by the draftsman thereby eliminating the fatigue of the draftsman.

Other objects and advantages of my invention will become more apparent after a careful study of the following detailed description taken together with the accompanying drawings which illustrate a preferred embodiment of my invention.

DESCRIPTION OF THE PREFERRED EMBODIMENT

Figure 1:
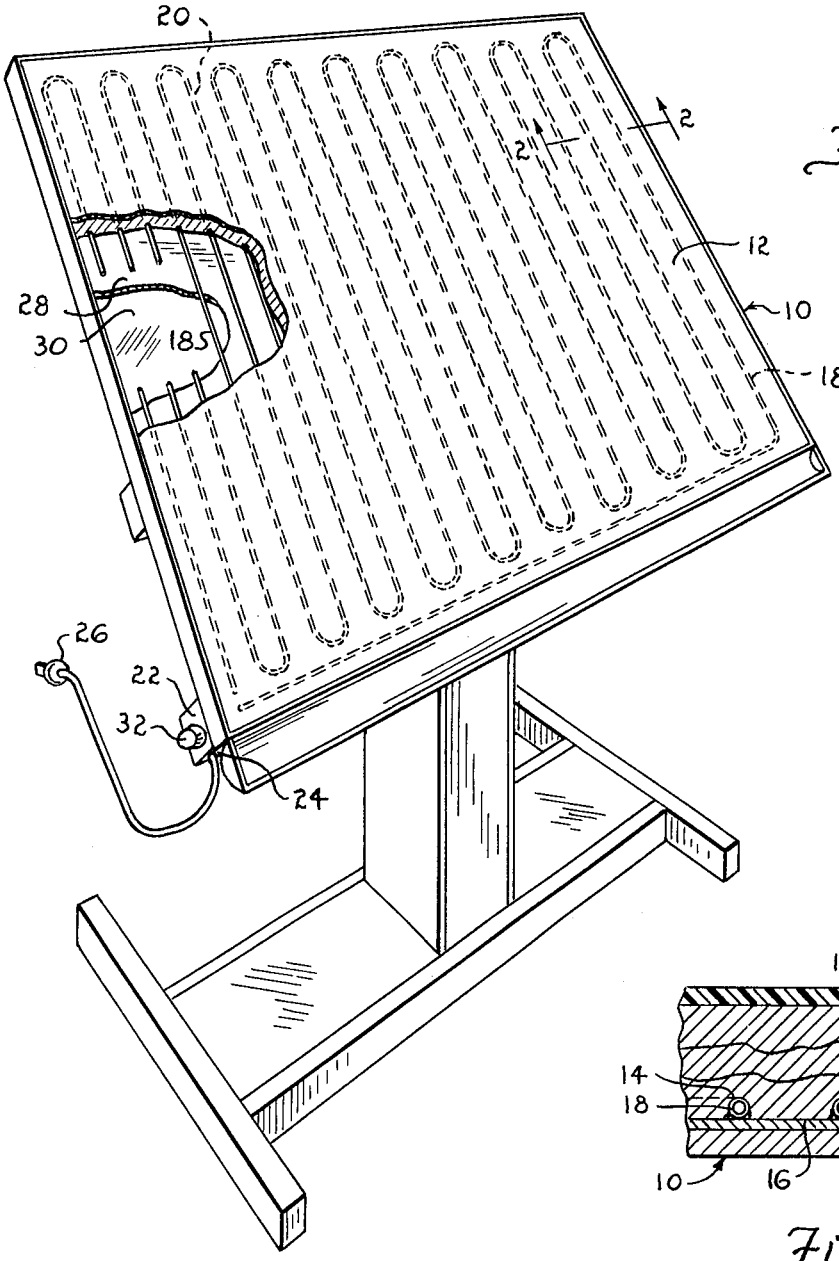
FIG. 1 is a perspective view of the drafting board of my invention shown partly broken away.
Figure 2:
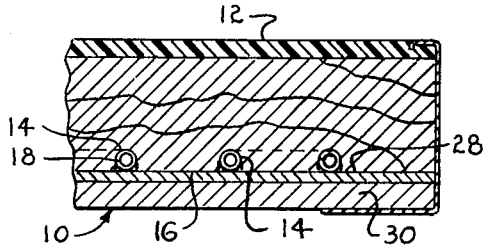
FIG. 2 is a cross sectional view of a fragment of the drafting board of my invention taken along lines 2—2 of FIG. 1.
Figure 4:
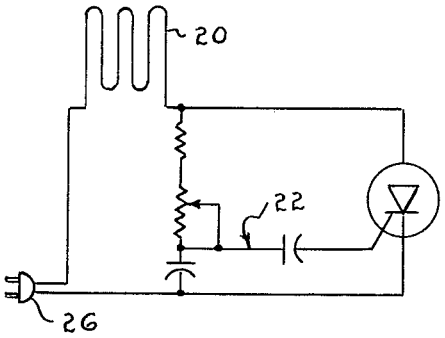
FIG. 4 is an electric circuit diagram of my invention.

Referring now more particularly to the drawings wherein is illustrated a preferred embodiment of my invention, numeral 10 designates generally the heated drafting board of my invention. It comprises a drafting board 12 formed with a plurality of parallel grooves 14 in the bottom side 16 of the drafting board regularly spaced across one, for example the longitudinal, dimension of the board. Grooves 14 extend longitudinally to substantially the lateral dimension of the board connecting at alternate ends to form a continuous groove having a generally serpentine configuration. I provide in continuous groove 14 across the length and width of the bottom side 16 of drafting board 12 an insulated electrically resistant heating wire 18 which forms a closed electrical circuit 20 as shown in FIG. 4. The heating circuit 20 terminates with a voltage control device 22 which is connected to the exterior of board 12 as at 24 for manual manipulation. The circuit terminates with plug 26 for insertion into an electrical receptacle. I prefer to provide a sheet of metal or foil 28 for covering the bottom of board 12 overlaying grooves 14 and contiguous with heating wires 18 throughout. Metal sheet 28 is connected to board 12 by any conventional method such as screws. Overlaying sheet 28 over its entire surface is cover member 30 formed from electrically and thermally insulated material such as wood or the like also connected to the board by any convenient means. Control device 22 for regulating the voltage to heating circuit 20 is manually adjustable by turning knob 32.

Figure 3:
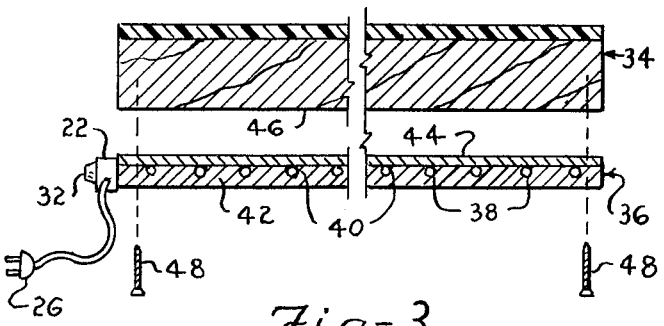
FIG. 3 is an end view of a drafting board heating panel of my invention in fragment for attachment to a prior art drafting board.

Though I have illustrated drafting board provided with electrical heating wires as an integral part thereof, prior art drafting boards such as 34 shown in FIG. 3 may be provided with a heating panel device 36 having heating wires 38 arranged in the same configuration fitted in similarly formed grooves 40 in panel member 42 which is overlayed with a heat reflective or conductive sheet material 44. Such panel structure of FIG. 3 may be added to the bottom side 46 of a prior art drafting board 34 by any convenient fastening means such as screws 48. Though I have illustrated a metal sheet as part of the structure of this invention in contact with the heating wires for serving to distribute the heat energy output of the heating circuits more quickly and evenly over the surface and through the drafting board, a drafting board structure lacking a metal sheet and having instead, a wood, plastic or composition panel would produce the desired results.

It is obvious that experimentation can easily be made to determine the required physical characteristics of the components of this invention such as the heat energy output per square foot of the heating wire circuit, the distance the heating wire is placed from the top surface of the drawing board and the spacing of the grooves, given the density of the wood of the drawing board and the ambient temperature of the drafting room in order to provide the board surface temperature range of 80° to 90° F. that I have found most satisfactory to eliminate the problems of the prior art above described.

I claim:

1. A drafting board having a top drawing surface and an opposed bottom surface, wherein the improvement comprises:

an electric resistant heating wire circuit connected throughout its length to said drafting board for heating said top drawing surface; and means connected to said circuit for connection to an electrical source.

2. A drafting board having a top drawing surface and an opposed bottom surface, wherein the improvement comprises:

an electric resistance heating wire circuit connected throughout its length to said bottom surface of said drafting board, said circuit arranged over said bottom surface in spaced rows over a substantial part of said bottom surface;

a receptacle plug means connected to said circuit;

voltage control means supported on said drafting board interposed between said receptacle plug means and said circuit; and a panel member planularly connected to said bottom surface fixing said circuit therebetween.

3. The drafting board of claim 2 wherein said panel member is further characterized as comprising a metal sheet for overlaying said heating circuit and an electric insulating sheet overlaying said metal sheet.

4. A drafting board having a top drawing surface and an opposed bottom surface, wherein the improvement comprises:

an electric resistance heating wire circuit embedded in said drafting board between said drawing surface and said bottom surface, said wire arranged therein in spaced rows forming a continuous circuit throughout said board;

a receptacle plug means connected to said circuit; and voltage control means supported on said drafting board interposed in said circuit.

5. The combination of a heating device and a drafting board, wherein said heating device comprises:

panel members planularly connected together;

an electric resistant heating wire circuit interposed and fixed between said panel members;

a receptacle plug means connected to said circuit;

voltage control means interposed between said receptacle plug means and said circuit; and means for connecting said heating device planularly contiguous to said drafting board.

6. The combination of claim 5 wherein one of said panel members is a metal sheet.

7. The combination of claim 6 wherein the other of said panel members is a heat insulating sheet.

8. The combination of:

a drafting board having a top drawing surface and an opposed bottom surface;

drafting paper on said top drawing surface;

electric circuit means for heating said top drawing surface and said drafting paper thereon; and control means in said circuit means for controlling the temperature at said top surface of said drafting board and said drafting paper thereon.

* * * * *